US005598736A

United States Patent [19]

Erskine

[11] Patent Number: 5,598,736

[45] Date of Patent: Feb. 4, 1997

[54] TRACTION BENDING

[75] Inventor: Edward J. Erskine, Benson, N.Y.

[73] Assignee: N.A. Taylor Co. Inc., Gloversville, N.Y.

[21] Appl. No.: 445,171

[22] Filed: May 19, 1995

[51] Int. Cl.[6] ..... B21D 7/06

[52] U.S. Cl. ..... 72/389.6; 72/389.8; 72/390.4

[58] Field of Search ..... 72/389.1, 389.6, 72/389.8, 390.4

[56] References Cited

U.S. PATENT DOCUMENTS

| | | | |
|---|---|---|---|
| 3,260,091 | 7/1966 | Shaw, Jr. . | |
| 3,918,286 | 11/1975 | Whitehead . | |
| 4,005,593 | 2/1977 | Goldberg . | |
| 4,446,711 | 5/1984 | Valente . | |
| 4,515,004 | 5/1985 | Jaenson . | |
| 4,638,665 | 1/1987 | Benson et al. | 72/389.8 |
| 4,646,553 | 3/1987 | Tufte et al. . | |
| 4,788,847 | 12/1988 | Sterghos . | |
| 4,967,585 | 11/1990 | Grimaldo . | |
| 5,148,695 | 9/1992 | Ellis . | |
| 5,326,249 | 7/1994 | Weissfloch | 72/389.6 |
| 5,353,622 | 10/1994 | Theener | 72/380 |

*Primary Examiner*—David Jones

*Attorney, Agent, or Firm*—Nixon & Vanderhye P.C.

[57] ABSTRACT

A traction bending apparatus bends workpieces (such as tubes and aluminum extrusions) with good thickness and wrinkling control, in circular arcs or in shapes clearly distinct from circular arcs, with cold forging of the workpieces for springback control, with smooth symmetric bending of symmetrical parts, and with smooth bending of non-symmetrical parts, without jaw marks. The apparatus can readily effect multi-point bending and can be used with workpieces of any length. A stationary die support mounts a die adjacent a first end of the support, and has first and second control arms pivotally mounted to the die support second end. The first and second linear actuators, preferably hydraulic cylinder assemblies with piggyback pneumatic cylinder assemblies, are connected to the control arms to provide powered pivoting movement thereof. First and second traction arms are pivotally mounted to the control arm and have first and second workpiece engaging rollers. Third and fourth linear actuators, preferably hydraulic cylinders, are pivotally connected to the die support at an intermediate section, and to the traction arms. A stripper linear actuator is mounted to the die support to effect movement of the workpiece bent by the apparatus away from the die support, and a clamping linear actuator clamps the workpiece for good thickness and wrinkling control. A computer control mechanism (e.g. PLC) provides control of the linear actuators to effect desired bending.

28 Claims, 15 Drawing Sheets

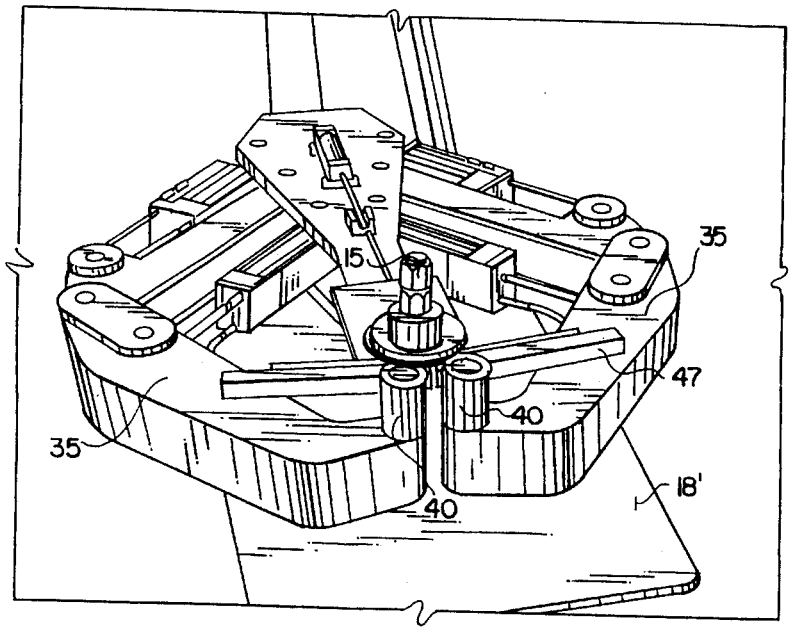
FIG. 4
FIG. 5
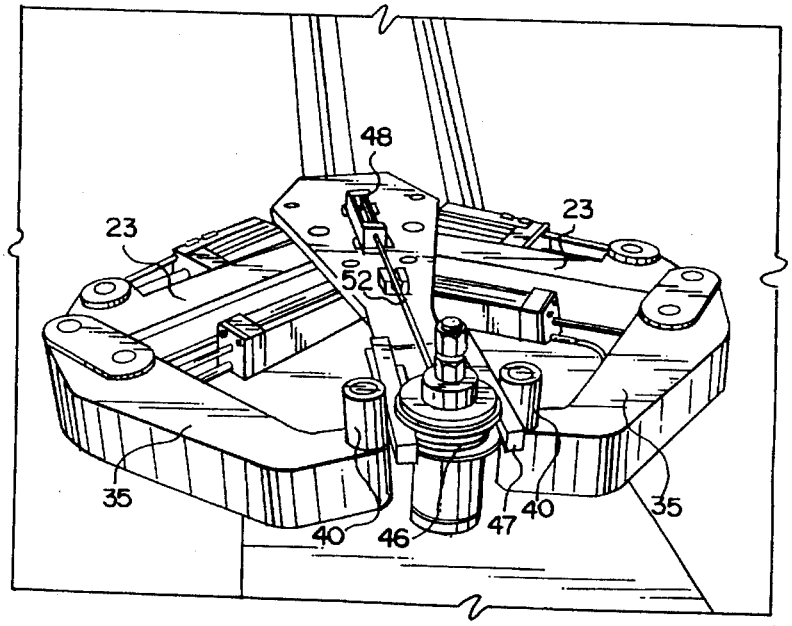

PLC
INITIALIZE
97
A
98
READ INPUTS
99
MODE
100
MANUAL
MANUAL INPUT DECODE
101
AUTO
B (FIG. 10)
106
AUTO COMMAND
102
YES
AUTO-MODE RESET
105
NO
ACTION
103
YES
ENERGIZE SOLENOIDS
104
NO
98
A

TRACTION BENDING

BACKGROUND AND SUMMARY OF THE INVENTION

The most common types of machines used for bending of bar stock, tubes, pipes, and extrusions are ram-type bending machines, three-roll benders, rotary compression benders, and rotary draw machines. While all of these machines can be utilized successfully to effect bending of certain types of workpieces, they all have limitations which make them less than ideal for certain situations. For example, rotary machines of both types can only bend workpieces into circular arcs and leave stop and start marks on the workpieces as a result of metal flow, while machines that effect stretch forming leave jaw marks at the ends of the workpieces which in some circumstances mean that at least portions of the workpiece are wasted.

According to the present invention a bending apparatus is provided which has unprecedented versatility and functionality, combining the best attributes of most of the prior art bending machines without the drawbacks associated therewith. The apparatus, and method of bending utilizing the apparatus, according to the present invention allow workpieces to be formed to virtually any shape that commercial prior art bending apparatus are capable of forming, provide independent control of components thereof to allow smooth bending of non-symmetric parts, optionally allow multipoint bending (e.g. three ninety degree bends), when effecting symmetric bends distribute excess metal to both ends for smoother and more symmetric bending without "stop and start" marks, effect bending by abutment engagement of the workpiece so that there are no jaw marks, as a result of having no obstructions on the top of the apparatus allowing bending of workpieces of any (unlimited) length, provide variable traction pressure to allow cold forging of workpieces for springback control, and by utilizing direct acting clamping of a workpiece provide constant pressure control of the clamp (with resultant workpiece thickness and wrinkling control).

According to one aspect of the present invention a traction bending apparatus for acting upon workpieces comprises the following elements: A stationary die support for mounting a die adjacent a first end thereof and having a second end remote from the first end, and an intermediate section between the first and second ends. At least a first control arm pivotally mounted at a first pivot axis to the die support at a first portion thereof, adjacent the die support second end. At least a first linear actuator pivotally connected to the first control arm at a second pivot axis and pivotally connected to the die support adjacent the die support second end at a third pivot axis, the first linear actuator providing powered pivoting of the control arm about the first pivot axis. At least a first traction arm pivotally mounted at a fourth pivot axis to the first control arm at a second portion of the first control arm, remote from the first portion of the first control arm, the fourth pivot axis adjacent but spaced from the second pivot axis. A workpiece engaging member associated with the first traction arm remote from the fourth pivot axis. And at least a second linear actuator pivotally connected to the first traction arm at a fifth pivot axis adjacent but spaced from the fourth pivot axis, and pivotally connected to the intermediate section of the die support at a sixth pivot axis, the second linear actuator providing powered pivoting of the first traction arm about the fourth pivot axis.

The apparatus preferably further comprises a stripper linear actuator mounted to the intermediate section of the die support for effecting movement of a workpiece bent at a die mounted by the die support first end away from the die support, and the clamping linear actuator for clamping the workpiece at a die mounted at the die support to provide workpiece thickness and wrinkling control. All the linear actuators preferably comprise hydraulic piston and cylinder assemblies, and a control mechanism is provided for controlling the linear actuators by selectively controlling supplied hydraulic fluid to the piston and cylinder assemblies. The control mechanism may comprise: a computer; a plurality of limit and pressure sensors providing input to the computer; a plurality of solenoids controlled by the computer for completely independently controlling the flow of hydraulic fluid to each of the hydraulic piston and cylinder assemblies; and an hydraulic pump controlled by the computer.

The workpiece engaging member preferably comprises a separate and distinct element extending outwardly from the traction arm and including a pin defining an axis and connected to the traction arm, and a roller surrounding the pin. The roller makes abutment (only) contact with the workpiece to effect bending.

According to another aspect of the present invention traction bending apparatus for bending workpieces is provided comprising the following elements: A stationary die support for mounting a die adjacent a first end thereof and having a second end remote from the first end, and an intermediate section between the first and second ends. First and second control arms pivotally mounted at first and second pivot axes, respectively, to the die support at a first portion of each, adjacent the die support second end. First and second linear actuators connected to the first and second control arms, respectively, providing powered pivoting of the control arms about the first and second pivot axes, respectively. First and second traction arms pivotally mounted at third and fourth pivot axes, respectively, to the first and second control arms at a second portion of the control arms, remote from the first portion of each control arm. First and second workpiece engaging members associated with the first and second traction arms remote from the third and fourth pivot axes. Third and fourth linear actuators connected to the first and second traction arms, respectively, providing powered pivoting of the traction arms about the third and fourth pivot axes, respectively. And a control mechanism for allowing at least one of manual, semi-automatic, and automatic control of the linear actuators to move the workpiece engaging members into operative association with a workpiece engaging a die mounted on the die support to effect desired bending of the workpiece.

The first and second linear actuators may be hydraulic piston and cylinder assemblies with piggyback pneumatic piston and cylinder assemblies to actuate associated limit switches (e.g. Reed switches). A stripper linear actuator and a clamping linear actuator are also preferably provided, and all of the linear actuators are preferably hydraulic piston and cylinder assemblies. The first and second linear actuators are pivotally mounted to the first and second control arms, respectively, at fifth and sixth pivot axes adjacent, but spaced from, the third and fourth pivot axes, while the third and fourth linear actuators are pivotally mounted at a first end of each to the intermediate portion of the die support at seventh and eighth pivot axes, respectively, and at a second end to each traction arm at ninth and tenth pivot axes, respectively, the ninth and tenth pivot axes being adjacent but spaced from the third and fourth pivot axes.

The control mechanism, which includes a computer, limit and pressure sensors, solenoids, hydraulic pump, and the like, comprises means for, after a workpiece is brought into operative contact with a die supported by the die support: Actuating the clamping linear actuator to clamp the workpiece to prevent wrinkling; then controlling the third and fourth linear actuators to swing the traction arms to move the workpiece engaging members into operative association with the workpiece, and apply pressure thereto; then controlling the first and second linear actuators to retract the control arms while the traction arms continue to apply pressure to the workpiece so that the workpiece conforms to the die mounted by the die support; then de-actuating the clamping linear actuator to unclamp the workpiece, and controlling the third and fourth linear actuators to swing the traction arms away from the workpiece; and then actuating the stripper linear actuator to push the bent workpiece away from the die supported by the die support.

According to yet another aspect of the present invention a method of effecting bending of a workpiece (typically a pipe or like tubular element, or an aluminum extrusion) using a stationary die, clamping flanges at the stationary die, and powered workpiece engaging elements, is provided. The method comprises the steps of substantially sequentially: (a) Bringing a workpiece into contact with the stationary die. (b) Effecting direct linear movement of the clamping flanges to provide constant pressure clamping of the workpiece at the die to control thickness and wrinkling of the workpiece. (c) Swinging the workpiece engaging elements into operative abutting contact with the workpiece, and applying pressure to the workpiece with the workpiece engaging elements. (d) While continuing to maintain pressure on the workpiece with the workpiece engaging elements, moving at least one of the workpiece engaging elements with respect to the stationary die to effect smooth bending of the workpiece while continuing operative abutting contact with the workpiece. And (e) after desired bending of the workpiece, swinging the workpiece engaging elements out of abutting contact with the workpiece, and releasing clamping of the workpiece.

The method also typically comprises the further step between steps (a) and (c), of bringing one or more follow blocks into engagement with the workpiece at a portion of the workpiece opposite the die; and wherein steps (c) and (d) are practiced with the workpiece engaging elements directly abutting the follow blocks and through the follow blocks engaging the workpiece. Also, there is typically the further step, after step (e) of effecting powered linear movement of the workpiece away from the die.

Steps (a) through (e) are typically practiced so that bending takes place in a generally horizontal plane without top constraints, so that any length workpiece can be bent. Steps (c) and (d) are typically practiced by applying a variable pressure with the workpiece engaging elements to effect cold forging of the workpiece for springback control. Also, steps (c) and (d) are: practiced by providing independent variable control of each of the workpiece engaging elements to provide smooth bending of non-symmetric workpieces.

Step (d) may be practiced by moving both of the workpiece engaging elements with respect to the die to effect smooth symmetric bending of the workpiece, with rolling operative abutment of the workpiece. Also the die may be provided with a shape that is either a circular arc, or clearly distinct from the circular arc in which case steps (a) through (e) are practiced so that the workpiece is bent with at least one bend clearly distinct from a circular arc.

It is a primary object of the present invention to provide a versatile and highly effective bending apparatus, and method of effecting bending of workpieces. This and other objects of the invention will become clear from an inspection of the detailed description of the invention and from the appended claims.

BRIEF DESCRIPTION OF THE DRAWINGS

FIG. 4 is a view like that of FIG. 1 showing the workpiece engaging elements in engagement with the workpiece/follow blocks at the initiation of the bending action;

FIG. 5 is a view like that of FIG. 3 showing the position of the components at the end of the bending action;

DETAILED DESCRIPTION OF THE DRAWINGS

Figure 1:
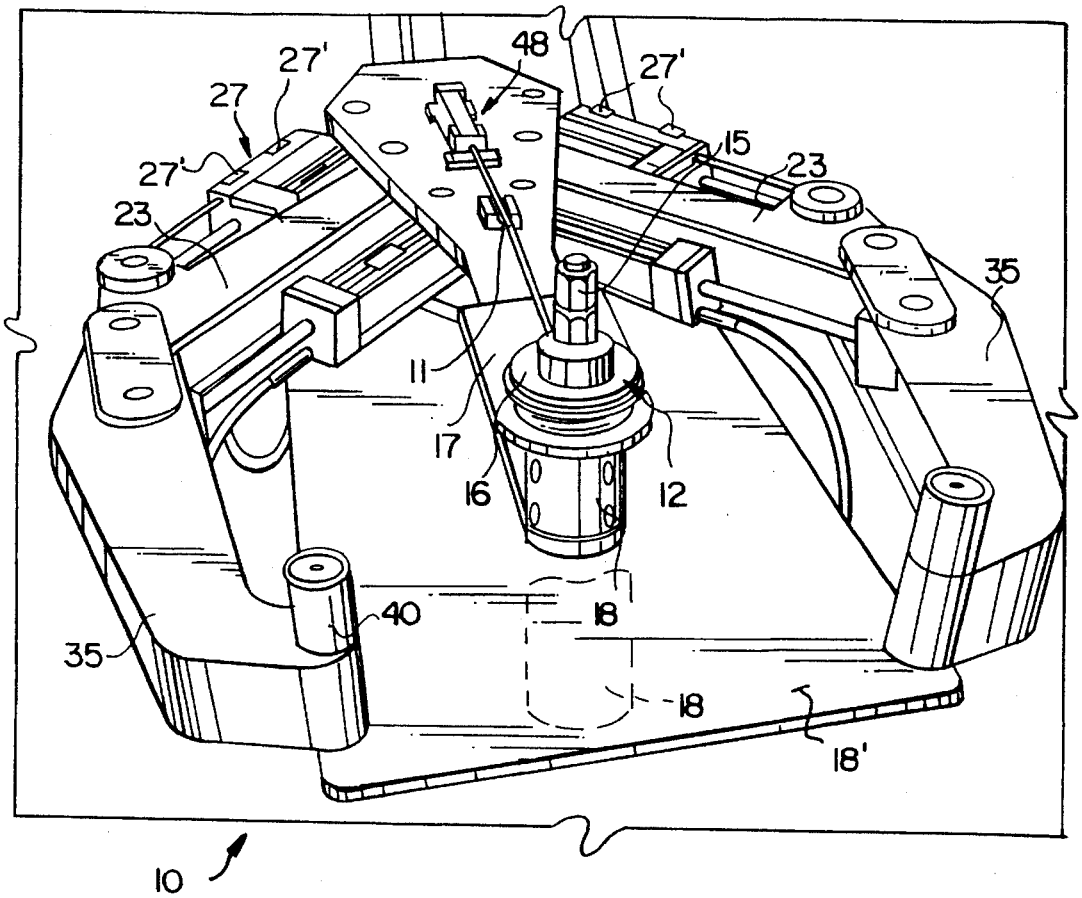
FIG. 1 is a top perspective view of an exemplary traction bending apparatus according to the present invention in the initial position waiting receipt of a workpiece to be bent therein.

Traction bending apparatus according to the present invention is shown generally by reference numeral 10 in FIGS. 1 through 6. A stationary die support 11 (e.g. a steel plate) is provided for mounting a die—shown generally by reference numeral 12 in FIG. 1—at a first end 13 (see FIG. 2 thereof). The die 12 is preferably mounted on a steel shaft 14 (see FIG. 2) that extends upwardly through the top surface of the die support 11 from a linear actuator (18) mounted under the table (18') and is threaded at the end remote from the die support 11 to receive nuts 15 (see FIG. 1) thereon which hold a die pack, including the die 12, in place. In the embodiment illustrated in FIG. 1, the die 12 has a circular arc, but according to the invention dies of almost any configuration can be utilized, and the operation of the apparatus 10 is accommodated to effect proper bending of a workpiece according to the shape of the die 12.

The die pack associated with the die 12 also comprises an upper flange 16 and a bottom flange 17. Clamping action to clamp a workpiece in place in association with the die 12 is provided, according to the present invention, by utilizing a clamping linear actuator 18 (see FIGS. 1, 2, and 7 in particular, shown in dotted line in FIGS. 1 and 2 since it is under table 18'). The clamping linear actuator 18—as see in FIG. 7—preferably comprises a hydraulic piston and cylinder assembly, having a cylinder 19 (see FIG. 7) that is about four inches in internal diameter, with the piston having a piston rod 20 which is about 1.75 inches in diameter. The actuator 18 need only have a very short stroke distance, e.g. a quarter of an inch. Because the actuator 18 provides direct action, moving the top flange 16 toward the bottom flange 17 (as opposed to a toggle linkage movement or the like), constant pressure is provided so that workpiece thickness and wrinkling control is optimized.

Figure 2:
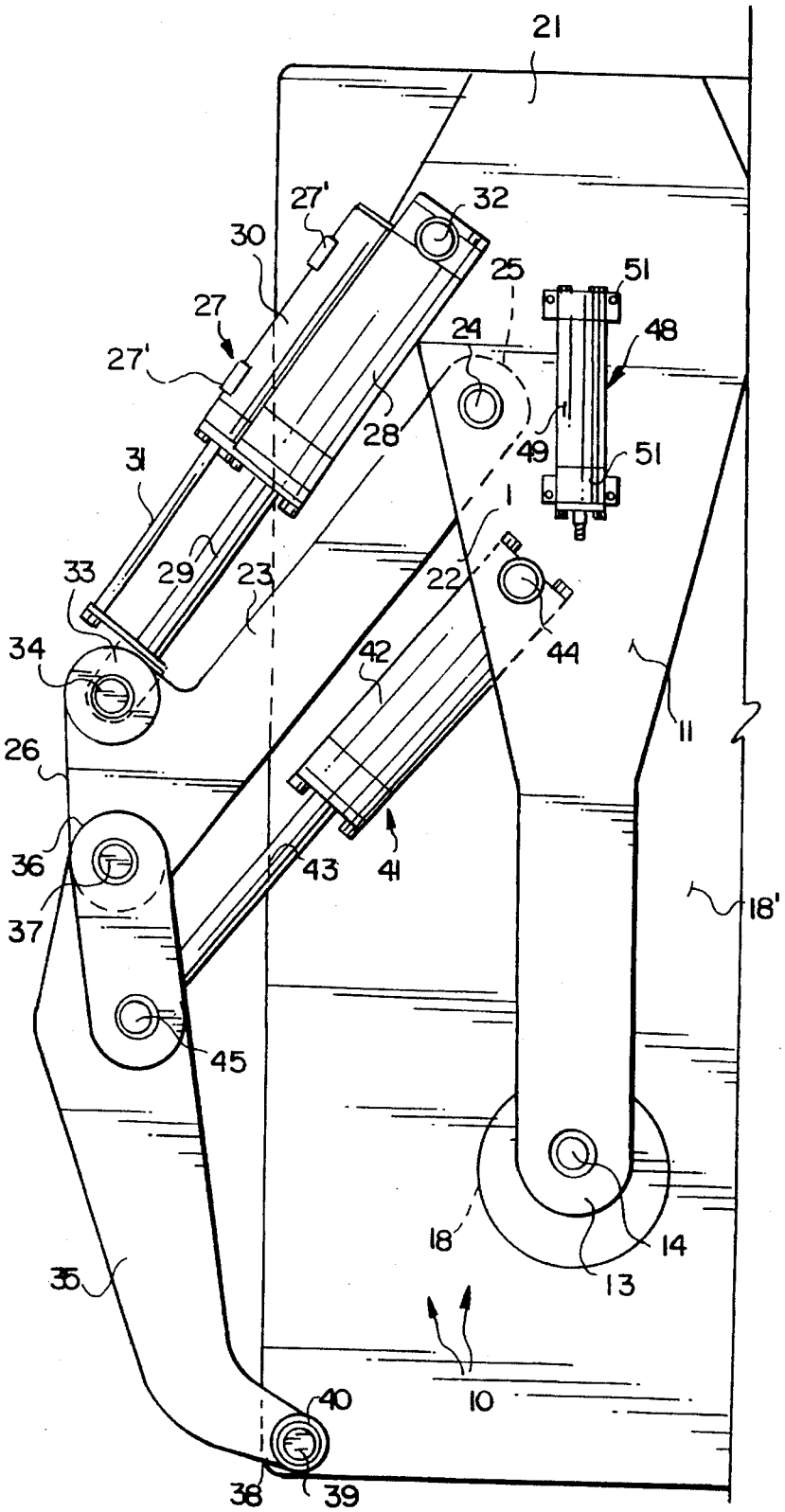
FIG. 2 is a top detail view of just the die support and the left (as viewed in FIG. 1) control and traction arms of the apparatus of FIG. 1.

The die support 11 includes a second end 21 remote from the first end 13, and an intermediate section shown generally at 22 in FIG. 2. Pivotally connected adjacent the second end 21 of the die support 11 are first and second control arms 23. While typically two control arms 23 are provided, under some circumstances the apparatus 10 may utilize only a single control arm 23, and utilize another or an additional type of clamping mechanism to hold the workpiece in place during bending.

Each control arm 23 is preferably pivotally mounted to the die support 11 by a steel pivot pin 24 (see FIG. 2) typically mounted in a bushing and normally defining a generally vertical axis about which pivoting of the control arm 23 takes place, although under some circumstances the orientation of the axis may be different. The pivot pin 24 is at a first end 25 of each control arm 23, while at the second end 26 thereof remote from the first end other pivotal connections are provided to be hereinafter described.

First and second linear actuators—shown generally by reference numerals 27 in FIGS. 1 through 7—are provided for effecting power pivotal movement of the control arms 23 about the axes defined by pins 24. In the preferred form illustrated in FIG. 2 each of the linear actuators 27 preferably comprises a hydraulic piston and cylinder assembly with a piggyback pneumatic cylinder assembly for control of limit switches 27'; e.g. two limit switches 27' (i.e. a front one and rear one) are associated with each linear actuator 27. For example, as seen in FIG. 2 a hydraulic cylinder 28 is provided having, in a preferred embodiment, a 3.5 inch internal diameter with a piston rod 29 associated therewith having a 1⅜% inch diameter, and a 9.75 inch stroke length. The pneumatic cylinder 30 has a piston rod 31 associated therewith and a magnetic piston 31', which actuates limit switches 27' (e.g. Reed switches). The internal diameter of the cylinder 30 may be 1.5 inches, the diameter of the piston rod 31 ⅝ of an inch, and the stroke length of the piston rod 31 about 10 inches.

Each linear actuator assembly 27 is preferably pivotally mounted at both ends thereof, being pivotally mounted at a first end thereof by a pivot pin 32 or the like (substantially identical to the pin 24 and parallel thereto) adjacent the second end 21 of the die support 11, and being pivotally mounted at the opposite end thereof by an extension 33 of the piston rods 29, 31 to a pivot pin 34 adjacent the second end 26 of the control arm 23, the axis defined by the pivot pin 34 being parallel to the axes of the pins 24, 32. When the piston rods 29, 31 are powered out of the cylinders 28, 30 the control arm 23 illustrated in FIG. 2 is pivoted counterclockwise about the pivot pin 24 axis, whereas when the piston rods 29, 31 are retracted the control arm 23 is pivoted clockwise.

The apparatus 10 further comprises a pair of traction arms 35, each traction arm 35 is pivotally connected adjacent a first end 36 thereof, for example by a pivot pin 37, to a control arm 23 adjacent the second end 26 thereof. The pivot pin 37 is preferably in a bushing and defines an axis parallel to the axes of the pins 24, 32, 34. Adjacent a second end 38 of the traction arm is a workpiece engaging member associated with each of the traction arms 35. While the workpiece engaging member may be merely a portion of the control arm 35 or oriented in a position in a particular manner, it preferably comprises a separate and distinct element extending outwardly (e.g. upwardly) from the control arm 35. For example, it may comprise—as seen in most clearly in FIG. 2—a steel pin 39 extending upwardly from the arm 35 and with a roller 40 (e.g. also of steel) rotatable with respect to the pin 39. Each pin 39 is typically parallel to the pins 24, 32, 34, 37. The rollers 40 are designed to merely abut, and roll with respect to, a workpiece so that no jaw marks or the like are left on the workpiece.

All of the arms 23, 35 may be integral structures (e.g. steel plates), either single or double, or may be constructed of a number of different elements connected together, again of either single or double construction (i.e. each arm 23, 35 may be a double arm, the arm elements parallel to and spaced from each other).

Powered pivotal movement of the traction arms 35 is effected utilizing linear actuators 41. Preferably each of the linear actuators 41 comprises a hydraulic piston and cylinder assembly, e.g. having a cylinder 42 with an internal diameter of about 3.25 inches, and with a piston rod 43 having a diameter of about 1⅜% inches. The total stroke length of the piston rod 43 inches may be 9.1 inches, but preferably a four inch stop tube is provided so that there is a net stroke length of about 5.1 inches. The linear actuator 41 is pivotally connected at a first end thereof, for example by pivot pin 44, to the intermediate section 22 of the die support 11, the axis defined by the pin 44 being parallel to that of the pin 24. The actuator 41 is pivotally connected at a second end thereof (e.g. the piston rod 43 is pivotally connected) to the traction arm 35, as by a pivot pin 45 parallel to the pins 44, 37. Note that the pins 34, 37 are adjacent but spaced from each other, and that the pins 37, 45 are adjacent but spaced from each other.

FIGS. 1 and 3 through 6 illustrate a typical operation of the apparatus 10 to effect bending of a workpiece. In this case the workpiece itself is seen, after bending, only in FIG. 6, being designated by reference numeral 46, while FIGS. 3 through 6 all illustrate follow blocks 47 associated with the workpiece 46. The follow blocks 47 are typically steel blocks which ride with the extrusion (workpiece 46) to smooth the bend of the extrusion (workpiece 46) and cooperate with the die 12.

Figure 3:
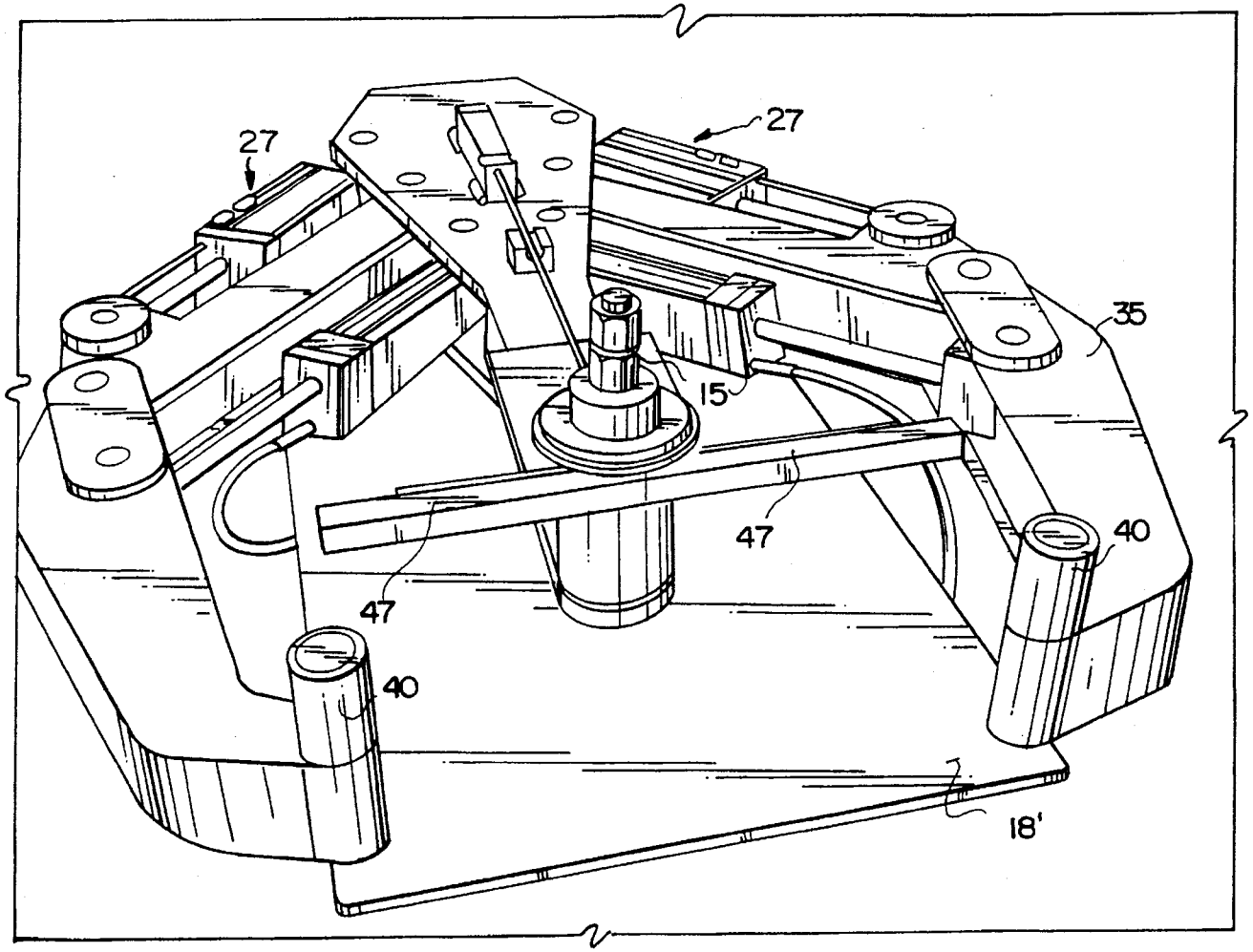
FIG. 3 is a view like that of FIG. 1 showing a workpiece, with follow blocks associated therewith, clamped in place waiting for the initiation of a bending action.

FIG. 3 shows the workpiece 46, with follow blocks 47 associated therewith, positioned in proper location with respect to the die 12 with the clamping actuator 18 having been operated so that the piston rod 20 is moved downwardly about ¼ inch to clamp the workpiece 46/follow blocks 47 between the flanges 16, 17 to properly hold them in place.

FIG. 4 shows actuation of the actuators 41 to retract the piston rods 43 so as to swing the workpiece engaging rollers 40 into initial engagement with the follow blocks 47, the rollers 40 applying pressure to the back of the workpiece 46 through the follow blocks 47. While the level of the pressure applied by the actuators 41 may be varied during the bending operation to provide cold forging of the workpiece 46 (for springback control) some pressure will be continuously applied thereby during the subsequent operation.

FIG. 5 illustrates operation of the control arms by retraction of the piston rods 29, 31 to move the rollers 40 toward the second end 21 of the die support 11 so as to effect the bending action. After bending is complete—as illustrated in FIG. 5—all of the actuators 27, 41 are actuated to swing the arm 23, 35 away from the workpiece 46, the clamping actuator 18 is actuated to move the piston rod 20 out of the cylinder 19 and thereby release clamping of the workpiece 46, and then the extrusion/workpiece 46 is ready to be removed from the die 12.

Figure 6:
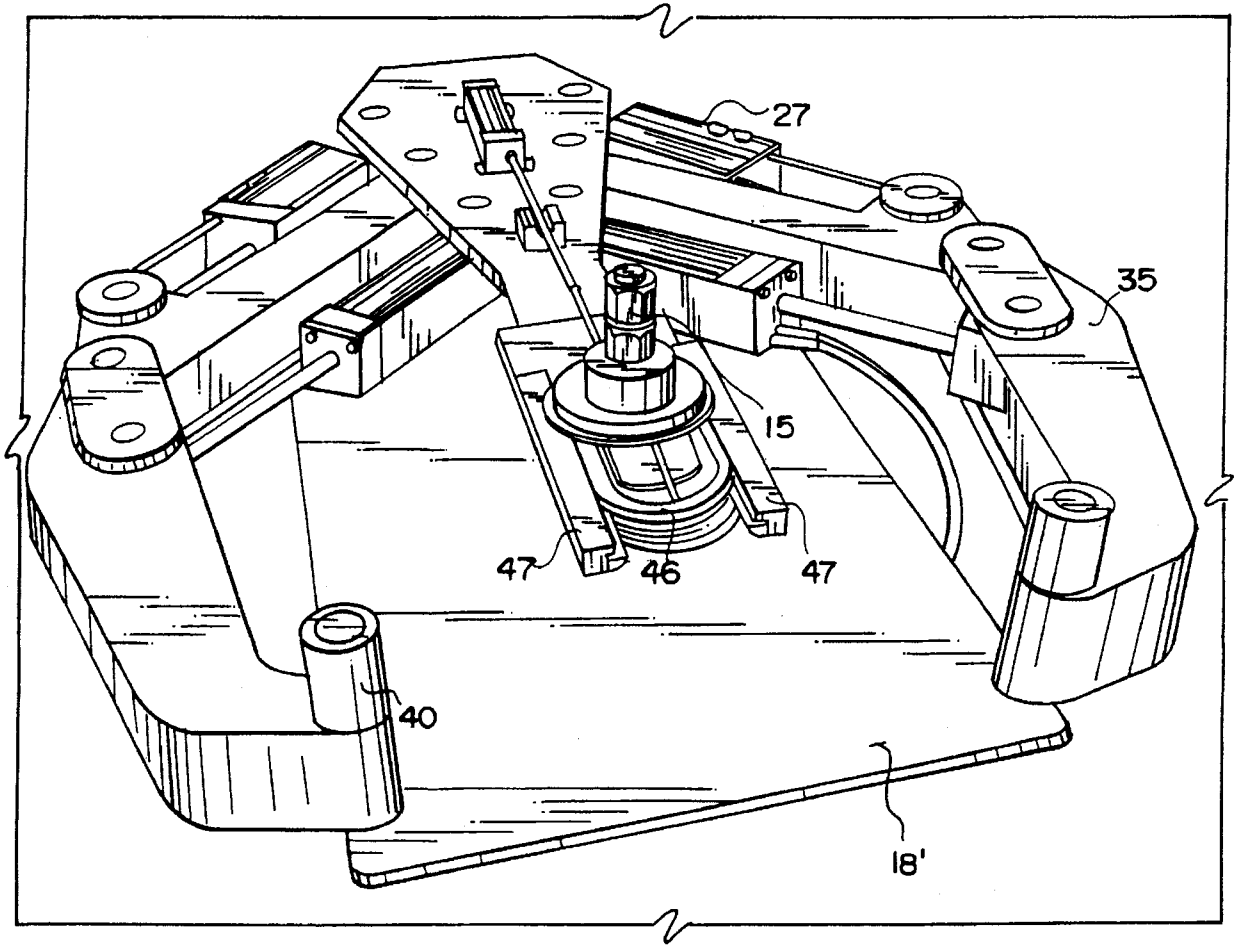
FIG. 6 is a view like that of FIG. 4 showing the control and traction arms opened up after the bending action and showing the stripper actuator having moved the workpiece out of engagement with the die.

Movement of the extrusion 46—after bending—away from the die 12 may be facilitated by using a stripper linear actuator, shown generally by reference numeral 48 in the drawings. The stripper actuator 48 preferably also is a hydraulic piston and cylinder assembly, e.g. having a cylinder 49 with a 1.5 inch internal diameter, a piston rod 50 with a ⅝ inch diameter, and a 6 inch stroke length for the piston rod 50. The cylinder 49 of the actuator 48 is stationarily mounted—as by mounting brackets 51 (see FIG. 2)—to the intermediate section 22 of the die support 11, and along a central line containing the post 14. The piston rod 50 may be guided in its linear movement by a linear guide bushing 52. At the end of the piston rod 50 remote from the cylinder 49 it may be connected to any suitable mechanism (depending upon the particular shape of the die 12, the particular workpiece 46 to be utilized, etc.) so as to engage the workpiece 46 and to push it away from the die 12, as illustrated in FIG. 6.

Figure 7:
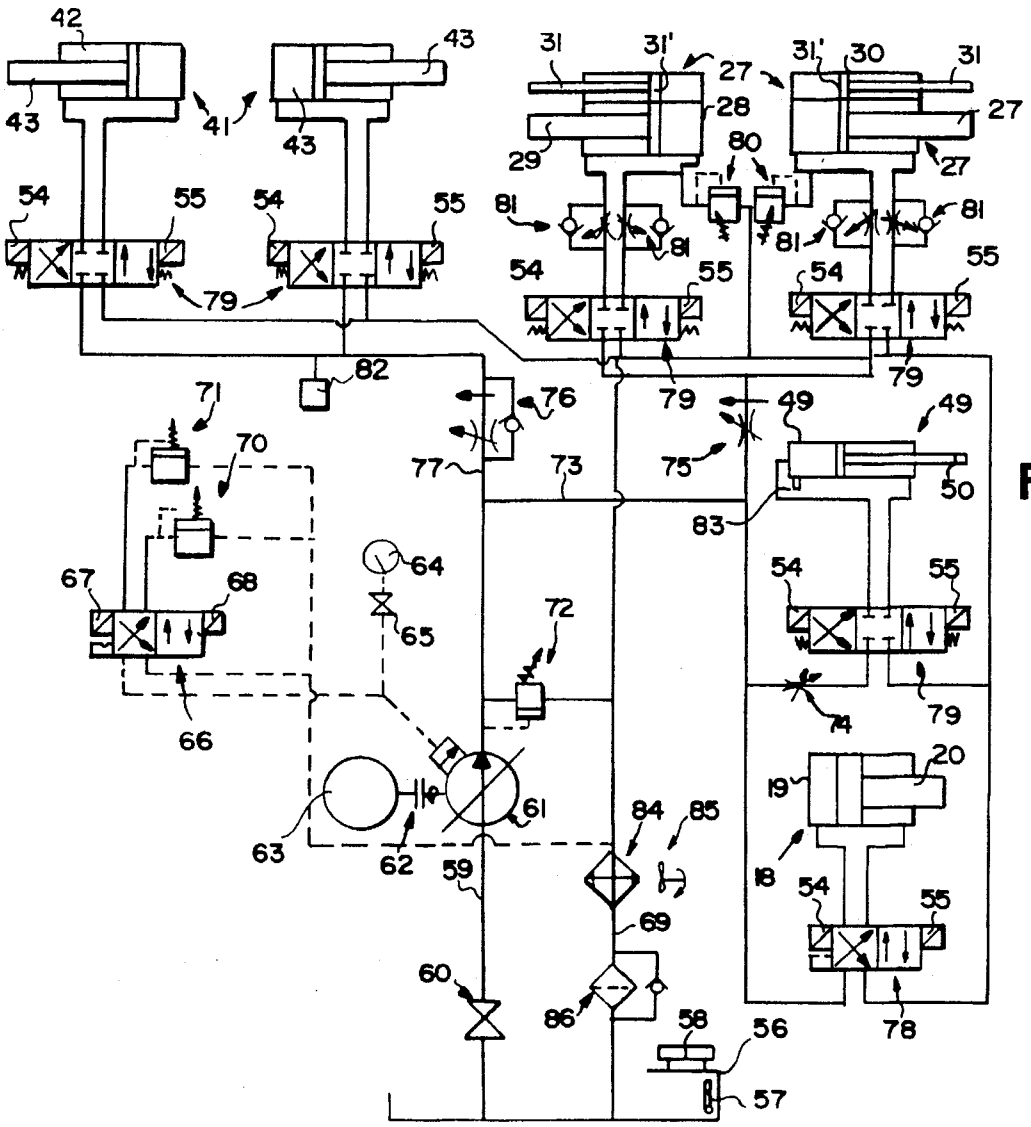
FIG. 7 is a hydraulic schematic for the apparatus of FIGURES through 6.

FIG. 7 is a hydraulic schematic showing of various control elements, etc., associated with the hydraulic circuitry for controlling each of the linear actuators 18, 27, 41, and 48. All of the elements in FIG. 7 are illustrated by standard hydraulic circuitry symbols. Note that in each case the flow of hydraulic fluid to the actuator is controlled by a valve, and that the positions of the valves are controlled by opposite solenoids 54, 55. While the solenoids 54, 55 associated with each of the valves for each of the linear actuators is a distinct separately controlled (by a computer as will be hereinafter described) structure, for simplicity the solenoids associated with each valve controlling each of the linear actuators are shown by the same reference numerals 54, 55.

The hydraulic circuit of FIG. 7 includes a reservoir 56 (e.g. 30 gallon) for hydraulic fluid which typically has sight and temperature gauges 57 associated therewith and a fill cap 58. Hydraulic fluid is pumped out of the reservoir 56 through line 59 which includes a ball valve 60 therein. The ball valve 60 must be open whenever the hydraulic pump 61 (e.g. a 7.8 gallon per minute variable volume pressure compensated hydraulic pump, e.g. such as a series PVP pump available from Parker Fluidpower) is running. The hydraulic pump 61 is coupled by a conventional motor coupling 62 to a motor adaptor and pump motor, both illustrated schematically at 63 in FIG. 7. For example, the pump motor 63 may be a 15 hp, 220/440 v, 60 Hz, 1800 rpm motor.

Mounted on a control panel a pressure gauge 64 is provided which is associated with the pump 61 and is controlled by a shutoff valve 65. A directional control valve 66, controlled by solenoids 67, 68, is operatively associated with the pump compensator 59 and the return line 69 to control the pressure of hydraulic fluid in the circuit. First and second remote relief valves 70, 71 are also provided, the valve 70 typically set for an "unload" compensator setting of about 300 psi, while the relief valve 71 may be set by an operator for a bend pressure. [The term "unload" as used herein refers to idling pressure while the operator is unloading (or loading) parts.] A factory adjusted (to about 3100 psi) pressure relief valve 72 connects the lines 59, 69 downstream of the hydraulic pump 61.

Header line 73 supplies hydraulic fluid from the main line 59, downstream of the pump 61, to each of the actuators 18, 27, 48. A flow control 74 is associated with the actuator 48, while a separate pressure compensated flow control 75 is associated with the actuators 27, and a pressure compensated flow control with a check valve 76 is associated with the actuators 41, supplied with hydraulic fluid via the branch line 77.

The valve 78 controlling the operation of the actuator 18 is a simple solenoid controlled directional control valve, having two positions. All of the other actuator control valves are shown by the same reference numeral 79 since they are in concept identical, being spring biased to a central position (illustrated in FIG. 7) in which no hydraulic fluid flows into or out of the actuator with which the valve 79 is associated but rather the piston rod (e.g. 50 for the actuator 48) associated therewith is maintained in the relative position to which it has been moved until the solenoids 54, 55 are controlled to provide fluid flow to one side of the piston or the other.

The hydraulic circuit components associated with the actuators 27 are slightly more complex than for the rest of the actuators. Safety relief valves 80 are associated with the actuators 27, as are additional flow controls with check valves 81, one of the assemblies 81 being associated with each of the lines leading to each of the cylinders 28, providing a bleed out flow control system that prevents cavitation of a cylinder when an external force is applied to a piston rod.

The final components of the hydraulic circuit of FIG. 7 include the pressure switch 82, which is, carefully matched to the unload compensator setting of about 300 psi, an end of stroke proximity switch 83 is associated with the cylinder 49, an air/oil heat exchanger 84 provided in the line 69 for cooling the oil being returned to the reservoir 56, an electric motor fan 85 typically providing forced air cooling for the heat exchanger 84, and a return line filter (with bypass check valve) 86. Other elements may also be included as desired or necessary, such as a remote compensator for the pump 61 and various other filters, flow controllers, pressure reliefs, manual actuator controls, and the like. Also, a variety of limit and pressure sensors are provided, which are illustrated schematically at 87 in FIG. 8.

Figure 8:
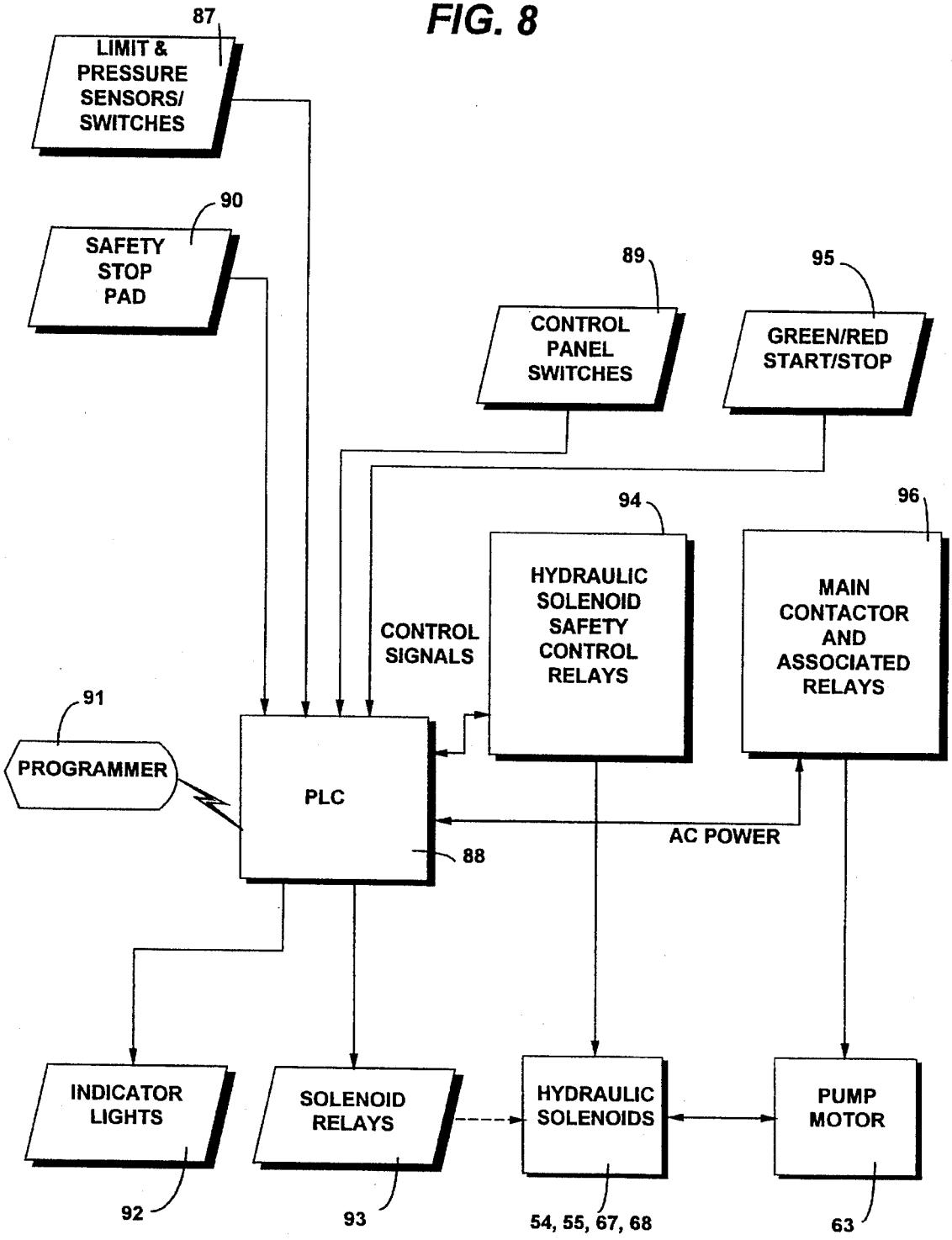
FIG. 8 is a control schematic illustrating the interconnection between various components of the apparatus.

FIG. 8 is a control schematic illustrating schematically the electrical controls for the entire control mechanism associated with the apparatus 10. The main element providing control is a PLC (programmable logic controller) 88 which receives inputs from the sensors 87, the control panel switches 89 (operated manually by an operator), and if desired a safety stop pad 90. The PLC 88 also receives input from a computer terminal 91 which may have a keyboard, mouse, and other components for inputting controls to the computer 88.

The PLC 88 controls indicator lights 92 on a control panel so that an operator can see what equipment is operable, and what state of operation it is in, as well as controlling solenoid relays 93 which ultimately control the solenoids 54, 55, 67 and 68. The pump motor 63 is typically controlled by a start/stop actuator 95 on the control panel, through the PLC 88, a main contactor and associated relays 96.

The control mechanism according to the present invention—illustrated schematically in FIGS. 7 and 8—typically provides manual, semiautomatic, and automatic control of the operation of the apparatus 10 to effect bending, based upon various operator inputs. FIGS. 9 through 13 are high level control schematics illustrating typical operations.

After the PLC 88 is turned on, an initialization function 97 (see FIG. 9) takes place. The manual mode control panel light is turned "on" to initially indicate manual mode, and then the main sequence loop 98 is initiated. The software or firmware associated with the PLC 88 reads the input ports, processes input data, and loops to repeat cycling until the proper instructions or conditions are determined. Overrides, such as emergency stops, etc., are separately processed. The input reading function is illustrated schematically at 99 in FIG. 9.

The first decision block 100 encountered relates to whether the apparatus 10 will be operated in a manual or automatic mode to effect bending. Assuming that the manual mode is selected at the decision block 100, a manual input decode sub-routine in the PLC 88 is run—as indicated schematically at box 101 in FIG. 9—to test for valid switch combinations. Manual control allows for actuation of any of the hydraulic solenoids 54, 55, 67, 68 in any combination (limited by the control panel switches) and the solenoids will be actuated as long as the corresponding switch is held in position. Any attempt to switch to automatic mode will be ignored if the control arms 23 are not at the front limit switches (shown only schematically at 87 in FIG. 8).

After the manual input decode box 101 there is the autocommand decision block 102. Assuming the decision there is "no", there is then the action decision block 103 where the associated "yes" energization of the solenoid is indicated at 104, and with a "no" response sequence looping back to 98. With a "yes" decision at block 102, the automatic mode reset is initiated, as indicated at block 105, and an amber light is turned on at the control panel to indicate automatic mode. The automatic mode is intended to cycle the arms 23, 35 to produce a desired bend. All manual control switches for arm movement will be ignored. Manual control of the stripper actuator 48 is allowed, however, unless two palm buttons are held down. The switch from automatic to manual mode is allowed at any time.

Figure 9:
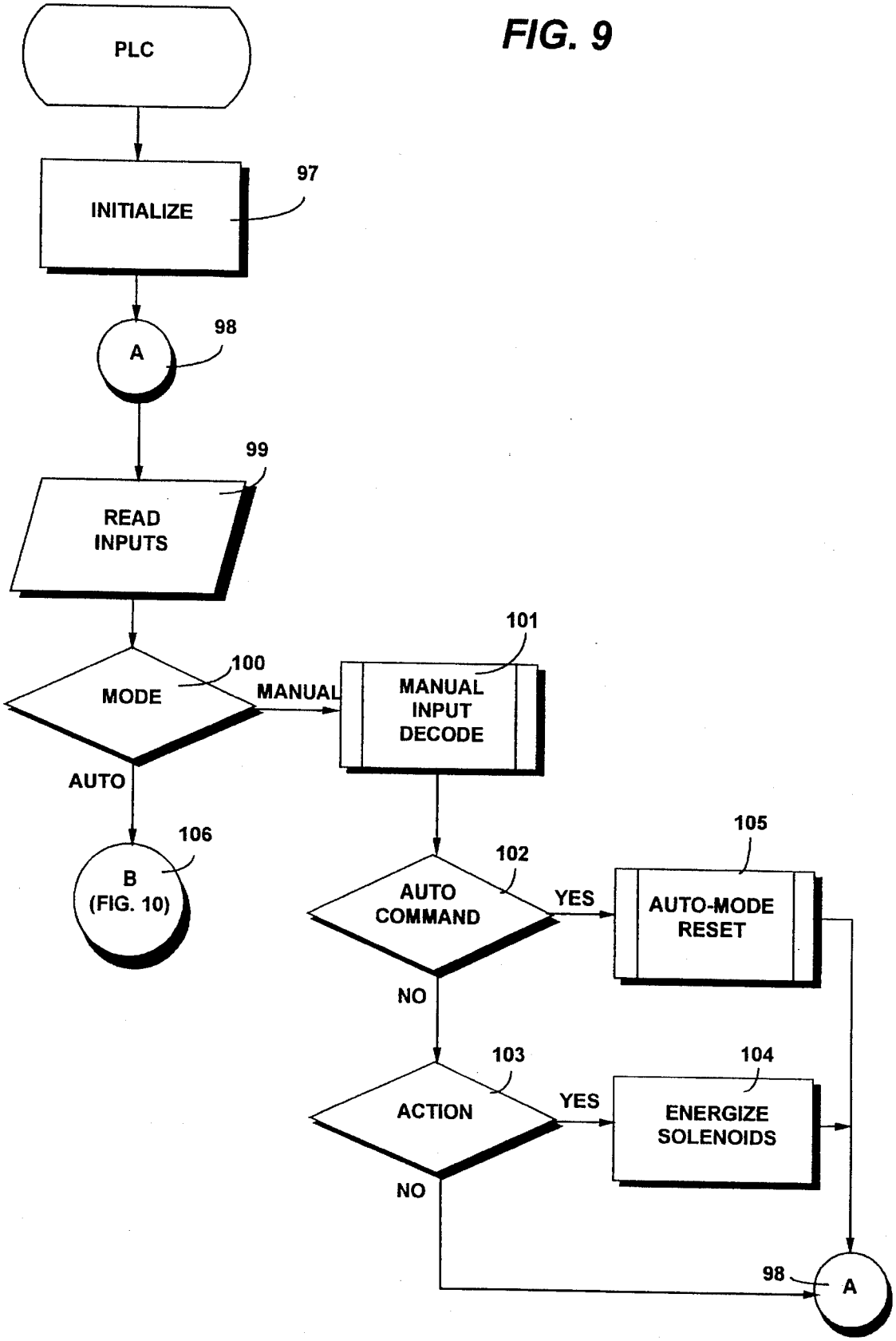
FIGS. 9 through 13 are high level flow sheets illustrating exemplary control sequences according to the present invention.
Figure 10:
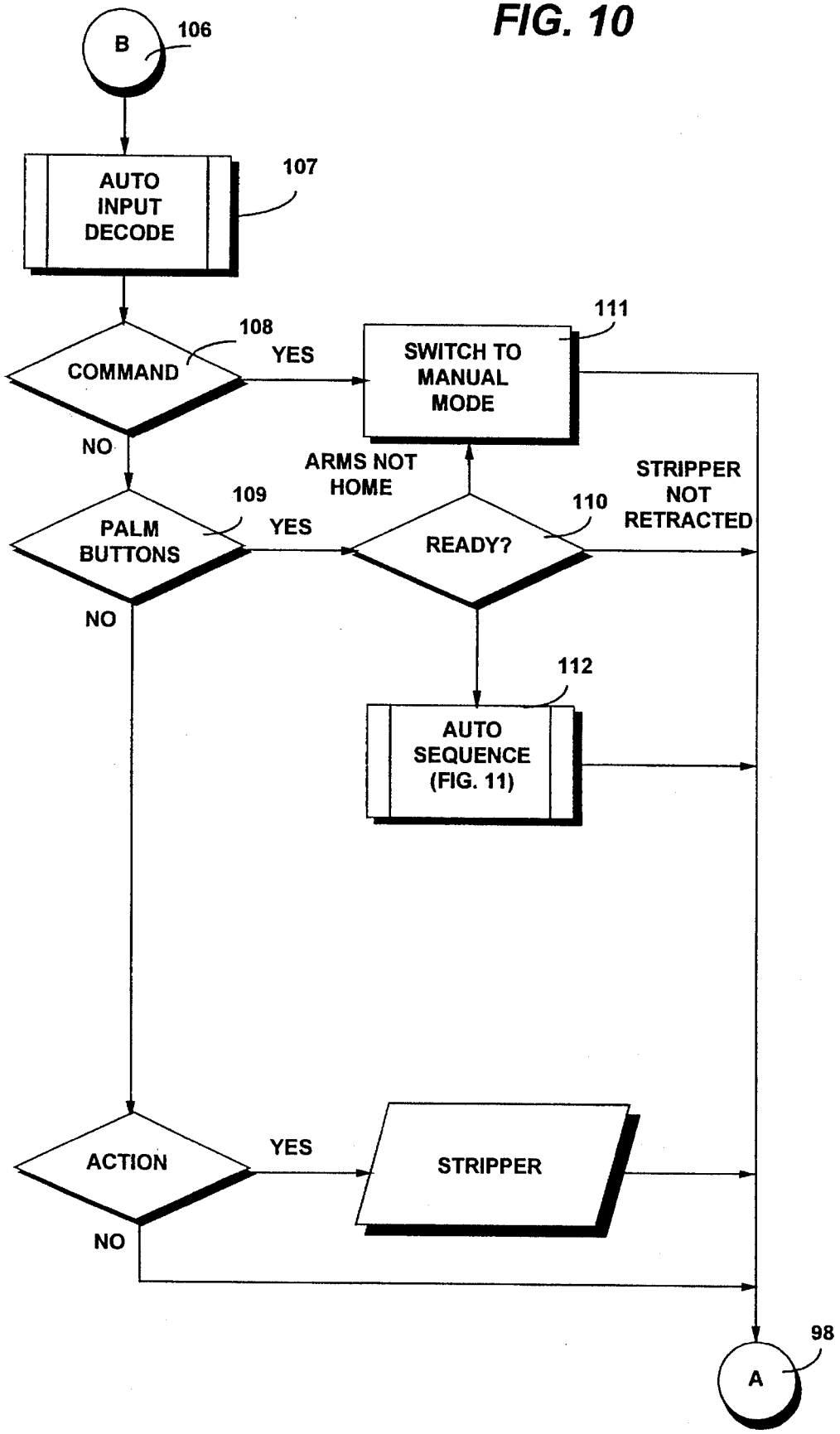
Figure 11:
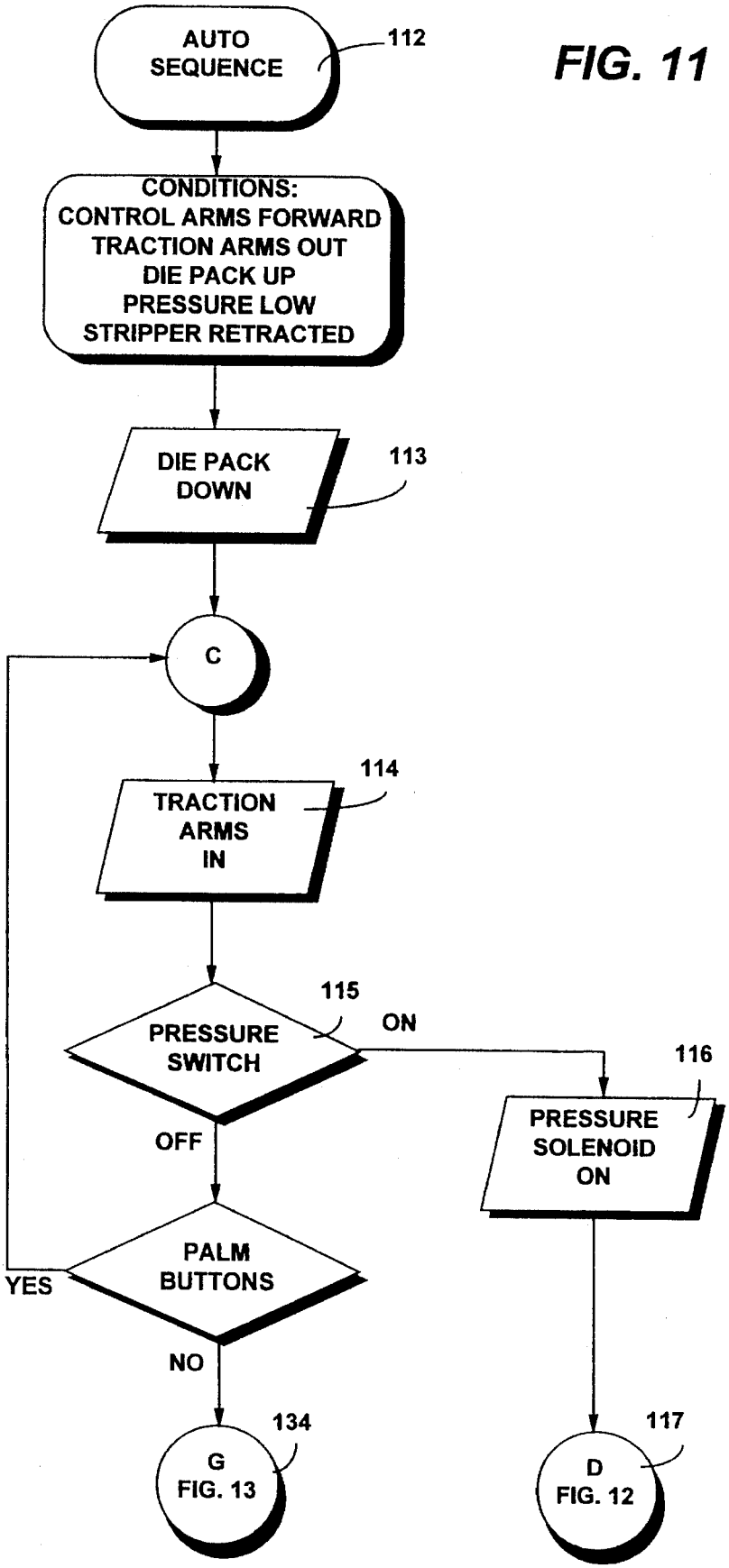
Figure 14:
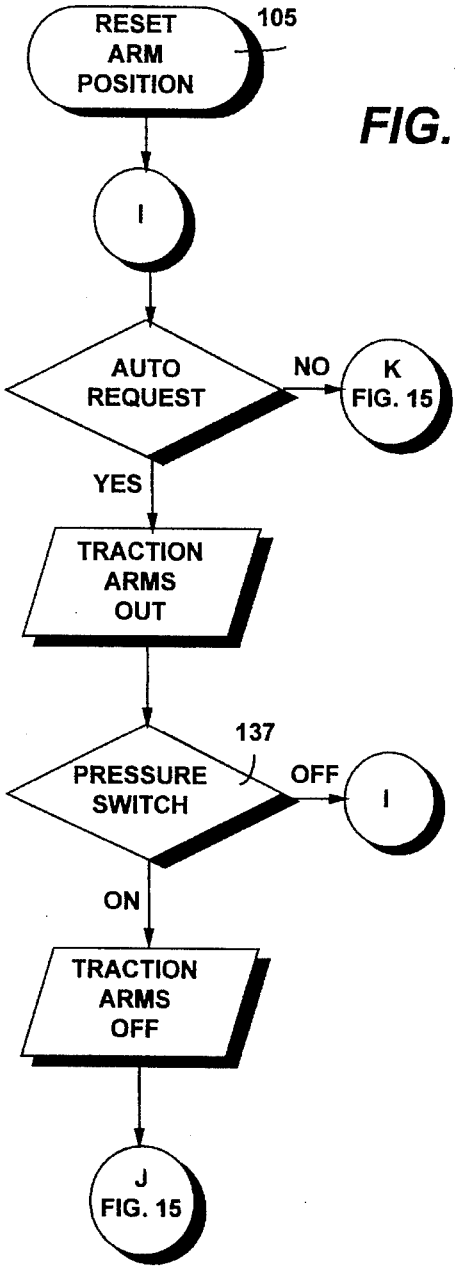
FIGS. 14 and 15 are high level flow sheets illustrating a reset arm control sequence according to the present invention.
Figure 15:
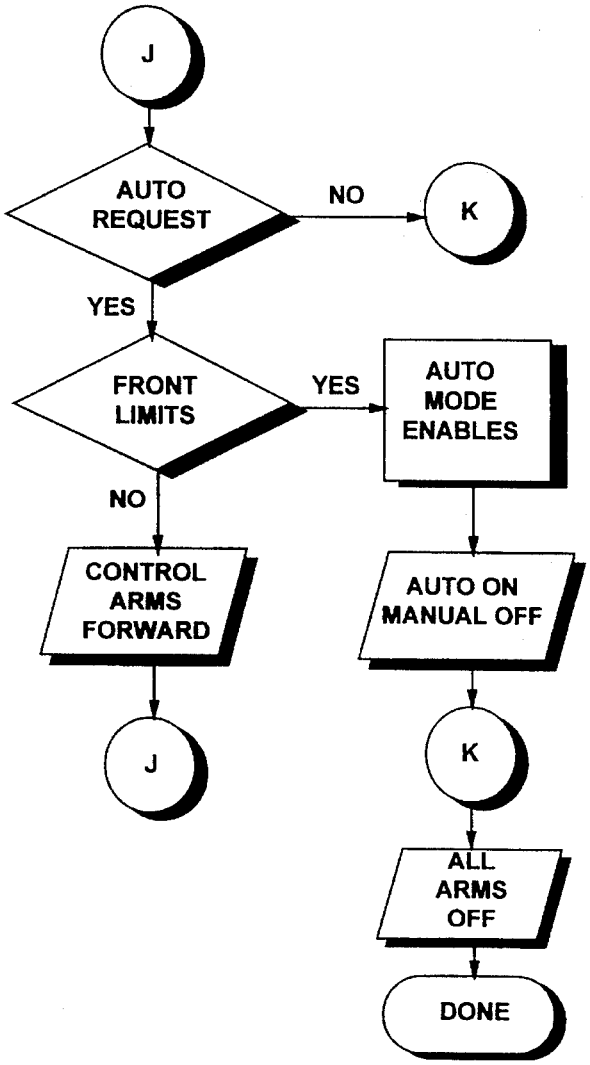

When passing from the auto mode reset 105 back to the main sequence loop 98, the decision block 100 will then indicate automatic mode, where loop B is indicated by reference numeral 106 in FIG. 9. The auto input decode box 107 is then implemented, with the automatic mode. The auto mode reset is illustrated in FIGS. 14 and 15, which will be described hereafter.

From the auto input decode 107 next there is a command decision block 108 which allows switch to manual or continuing (the "no" command) with the automatic sequencing. Assuming that the palm buttons are being held down, as indicated by decision block 109, the control sequence continues to the "ready" decision block 110. If the arms 23, 35 are not in the "home" position and the stripper retracted there is either a switch to the manual mode—which is indicated by block 111—or continued looping to sequence 98. Assuming neither of those conditions, then the automatic sequence—as indicated by box 112 and seen in FIG. 11—is initiated.

Auto sequencing will start if the following conditions are shown to exist and both palm buttons are held engaged: control arms 23 "forward"; traction arms 35 "out", the clamping cylinder (die pack actuator) 18 "up"; the pressure (sensed by switch 82) "low", and the stripper actuator 48 piston rod 50 retracted. Assuming those conditions exist then the first part of the automatic sequence, with the workpiece 46 in place, is as indicated by box 113 downward movement of the piston rod 20 of the actuator 18. Then the traction arms are moved in as indicated at 114 by actuation of the actuators 41. The traction arms 35 move in until the rollers 40 contact the follow blocks 47 or workpiece 46 (e.g. aluminum extrusion) to be bent. When both rollers 40 come into contact the system hydraulic pressure starts to rise. The pressure switch 82 is activated when the system hydraulic pressure reaches approximately 300 psi. When that occurs—as indicated by decision block 115 in FIG. 11—the solenoids 67, 68 are controlled as indicated at block 116, and actual bending is ready to begin. The routine D is indicated at block 117 in FIG. 11 and FIG. 12.

The sequence D—indicated by block 117—effects the actual bending in the automatic sequence. Hydraulic pressure is maintained in both sets of arms 23, 35, as long as the palm buttons are held down and the rear limit has not been reached. Releasing either palm button will de-energize the control arm 23 solenoids 54, 55 locking the control arms in place. As indicated by block 118 the control arms are retracted or moved "backwards" (see and compare FIGS. 4 and 5) while the traction arms are held "in" as indicated at 119. Once the rear limit has been reached—as indicated by decision block 120 in FIG. 12—that means that the control arms 23 have moved back far enough to operate the limit switches. The control arms 23 operate independently, each control arm 23 backward movement being stopped once its associated limit switch has been actuated, but not until then. Until the rear limit "yes" decision in decision block 120 is reached as long as the palm buttons have not been de-energized, as indicated by decision block 121, operation will continue. If the palm buttons have been de-energized, then the control and traction arms will turn off as illustrated by blocks 122, 123.

Figure 12:
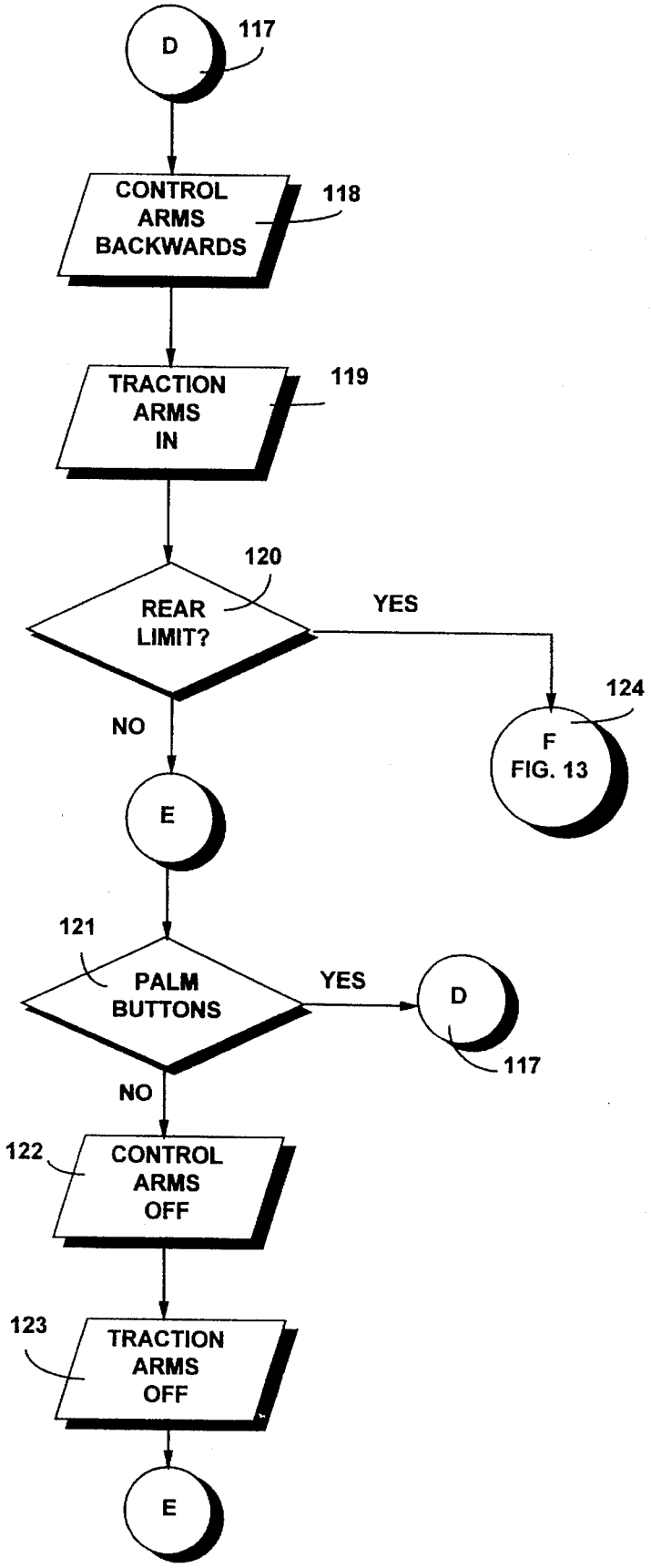
Figure 13:
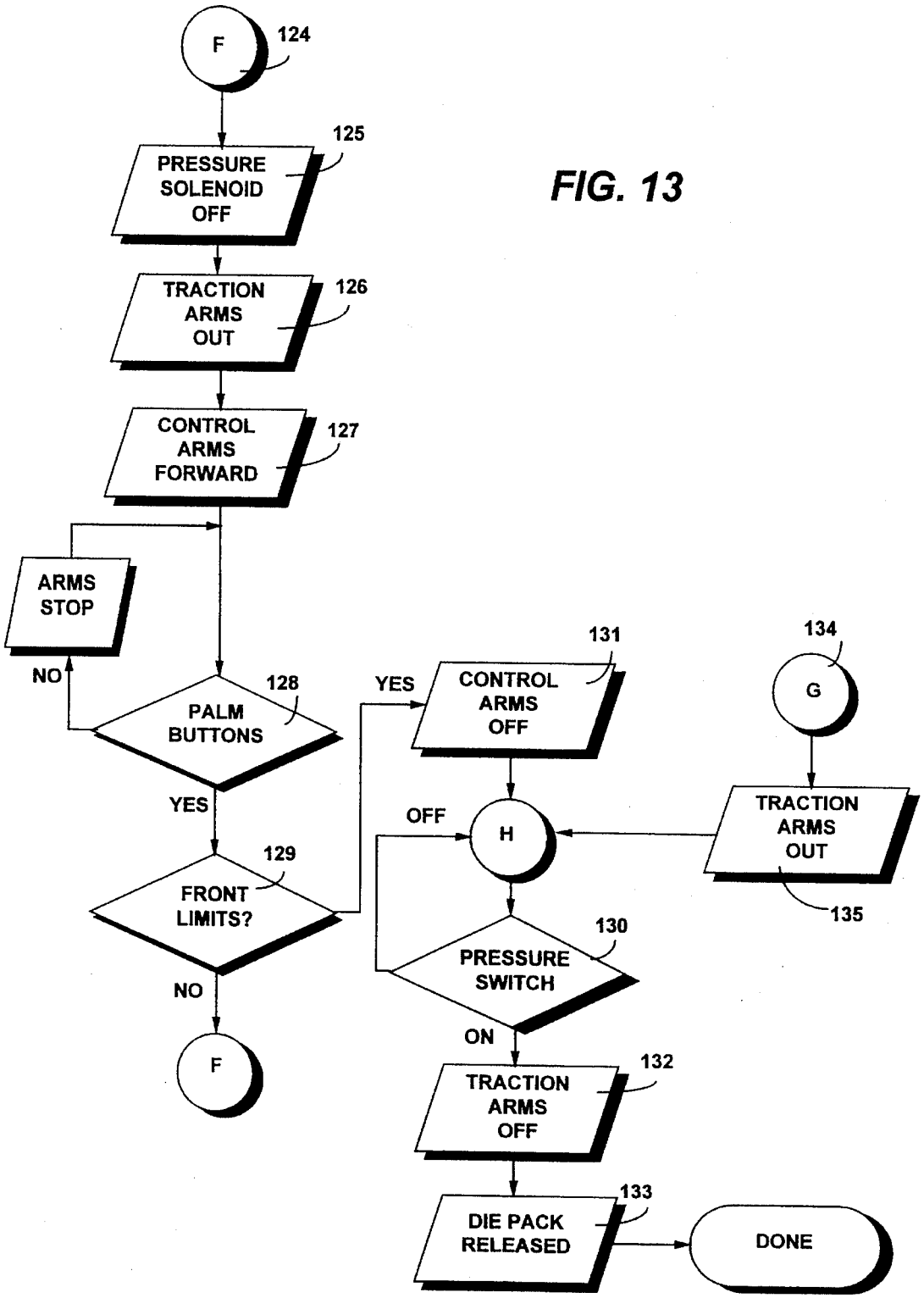

Once the rear limit—the "yes" decision from decision block 120—has been reached, then sequence F (illustrated in FIG. 13) is initiated, as shown by reference 124 in FIGS. 12 and 13. At this point bending is completed so that pressure solenoids 67, 68 are turned off as illustrated by block 125 and the arm motion is reversed. With no resistance on the arms the pressure in the hydraulic system drops and the pressure switch 82 opens, the traction arms moving out as indicated at 126, and the control arms 135 moving forward as illustrated by block 127. When a control arm 23 reaches its front limit the switch 79 associated with that control arm actuator 27 will be closed, stopping motion of that control arm 23. The hydraulic pressure always stays low until the traction arms 35 reach their outer stops. At that time the pressure builds and the pressure switch 82 closes again. At that time all the arms 23, 35 are stopped and the clamp cylinder 18 is opened (the piston rod 20 moves upwardly) so that the workpiece 46 is released. This is illustrated schematically by decision blocks 128, 129, 130 and by the operational box 131, 132, 133 in FIG. 13.

If the auto sequence is stopped by releasing the palm buttons before bending starts, as indicated by control sequence G, reference 134 (FIGS. 11 and 13), then the traction arms 35 are moved to the fully "out" position as illustrated by block 135 in FIG. 13, and the auto sequencing ends.

Figure 16:
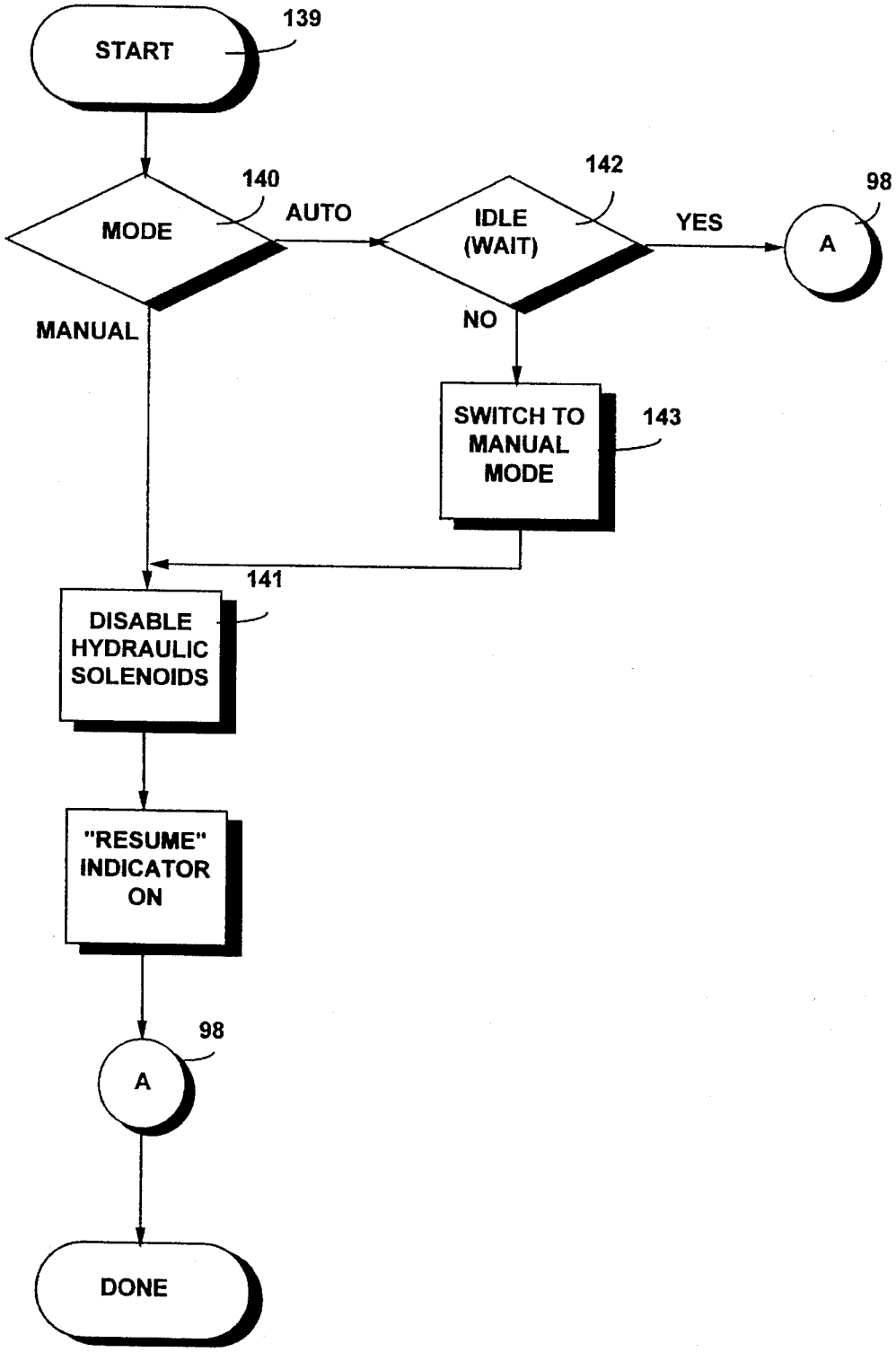
FIG. 16 is a high level schematic showing an emergency stop control schematic according to the present invention.

The auto mode reset—block 105 from FIG. 9—control sequence is seen in FIGS. 14 and 15. The routine illustrated in FIGS. 14 and 15 can be executed from the manual mode. This routine insures that the control arms and the traction arms are in the correct position before the auto mode is enabled. Movement will only be enabled while the manual/auto switch is held in the "auto" position. The various decision and operational blocks in the sequence of FIGS. 14 and 15 are self explanatory, the pressure decision block 137 relating to the pressure switch 82. Various emergency controls can also be provided for the apparatus 10. For example, FIG. 16 illustrates a control sequence for the emergency stop pad. Once the emergency stop pad is actuated—as indicated by block 139—first the mode of operation of the apparatus 10 must be determined, as indicated by control block 140. If in the manual mode the hydraulic solenoids are disabled as indicated by block 141, then sequencing is as illustrated at the lower part of FIG. 16. If in the "auto" mode then the "no" command from the decision block 142 is enabled, and the equipment switches to manual mode as indicated by block 143, and as described earlier regarding block 141. If there is a "yes" indication from the control 142, sequencing is already completed and the switch to manual mode as indicated in block 143 is unnecessary.

Figure 17:
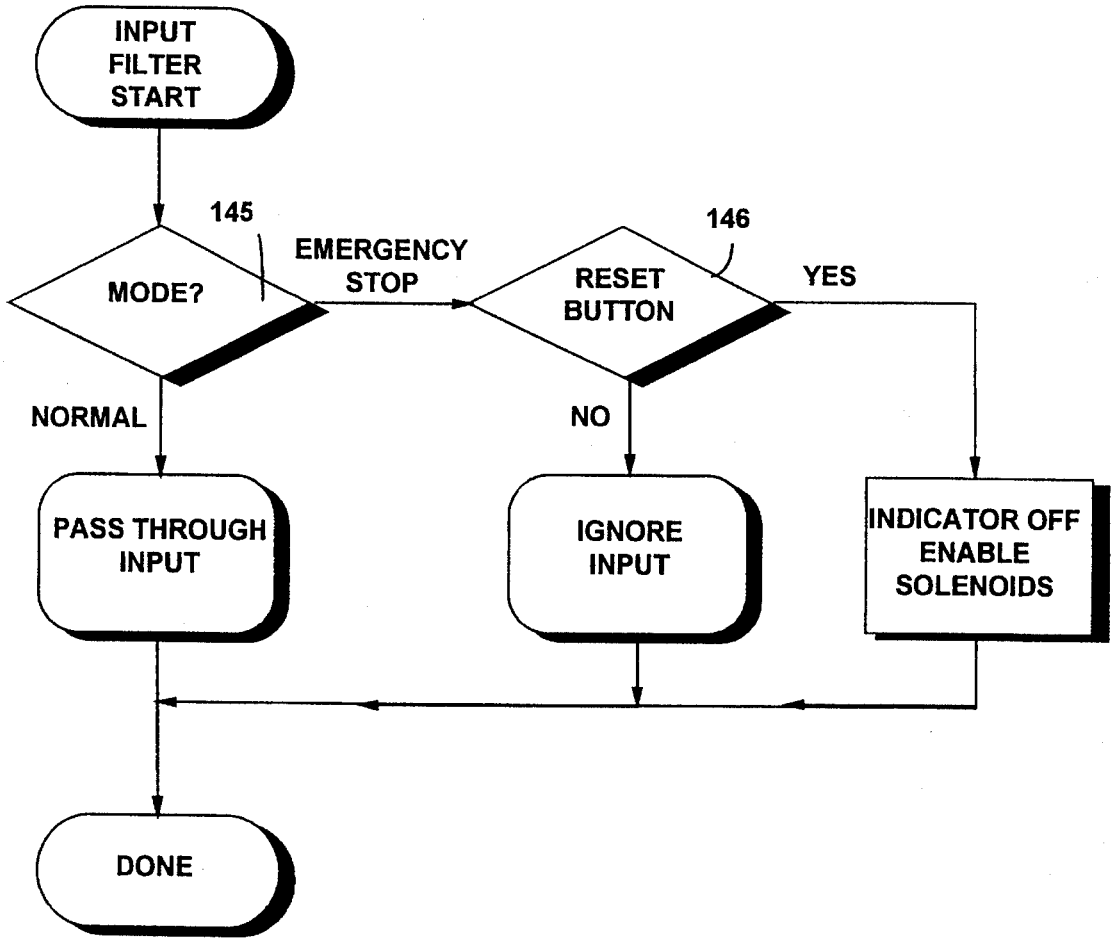
FIG. 17 is a high level flow chart illustrating an exemplary emergency stop reset function according to the present invention.

FIG. 17 schematically illustrates an emergency stop reset function. The function illustrated in FIG. 17 is typically part of an "input" command process. If the equipment is in the emergency stop mode with the reset light "on" and the hydraulics disabled, the only input accepted will be the reset input, as indicated by decision blocks 145, 146 in FIG. 17.

It will be seen that the apparatus 10 can use virtually any shaped die, not just circular arc dies as is necessary for conventional rotary machines. Variable traction pressure can be provided by controlling the pressure applied by the actuators 41 to allow for cold forging of workpieces for springback control. All of the actuators 27, 41 may be independently controlled so that each of the arms 23 is separately controlled and each of the arms 35 separately controlled, which allows smooth bending of non-symmetric workpieces. Since independent control arm 23 limits are provided, one arm may be used as a clamp (by adjusting the limit switch associated therewith) so that multi-point bending (e.g. four ninety degree bends) may be implemented. For symmetric part bending—as described with respect to FIGS. 4 through 6—since the bending is from the center the bend distributes excess metal to both ends for smoother and more symmetric bending. Also, since the rollers 40 abut the workpiece 46 (or follow blocks 47 and through the follow blocks 47 the workpiece 46) directly rather than grabbing them with jaws or the like, there is no "loss" of useful material at the ends of the workpieces like exists for stretch formed workpieces. Also, as clearly seen in FIGS. 1 and 3 through 6, the apparatus 10 is completely open at the top allowing virtually any length of workpiece 46 to be placed into operative association with the die 12.

It will thus be seen that according to the present invention a highly advantageous bending apparatus and method have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Traction bending apparatus for bending workpieces, comprising:

a stationary die support for mounting a die adjacent a first end thereof and having a second end remote from said first end, and an intermediate section between said first and second ends;

first and second control arms pivotally mounted at first and second pivot axes, respectively, to said die support at a first portion of each, adjacent said die support second end;

first and second linear actuators connected to said first and second control arms, respectively, providing powered pivoting of said control arms about said first and second pivot axes, respectively;

first and second traction arms pivotally mounted at third and fourth pivot axes, respectively, to said first and second control arms at a second portion of said control arms, remote from said first portion of each control arm;

first and second workpiece engaging members associated with said first and second traction arms remote from said third and fourth pivot axes;

third and fourth linear actuators connected to said first and second traction arms, respectively, providing powered pivoting of said traction arms about said third and fourth pivot axes, respectively; and a control mechanism for allowing at least one of manual, semiautomatic, and automatic control of said linear actuators to move said workpiece engaging members into operative association with a workpiece engaging a die mounted on said die support to effect desired bending of the workpiece.

2. Apparatus as recited in claim 1 wherein said first and second linear actuators are hydraulic piston and cylinder assemblies with piggyback pneumatic piston and cylinder assemblies.

3. Apparatus as recited in claim 1 wherein said first and second linear actuators are pivotally mounted to said first and second control arms, respectively, at fifth and sixth pivot axes adjacent, but spaced from, said third and fourth pivot axes.

4. Apparatus as recited in claim 3 wherein said third and fourth linear actuators are pivotally mounted at a first end of each to said intermediate portion of said die support, at seventh and eighth pivot axes, respectively, and at a second end of each to said traction arms at ninth and tenth pivot axes, respectively, said ninth and tenth pivot axes adjacent, but spaced from, said third and fourth pivot axes.

5. Apparatus as recited in claim 4 further comprising a stripper linear actuator mounted to said intermediate section of said die support for effecting movement of a workpiece bent at a die mounted to said die support first end away from said die.

6. Apparatus as recited in claim 5 further comprising a clamping linear actuator for clamping a workpiece at a die mounted at said die support first end to provide workpiece thickness and wrinkling control.

7. Apparatus as recited in claim 6 wherein said first through fourth, stripper, and clamping linear actuators comprise hydraulic piston and cylinder assemblies, and wherein said control mechanism comprises means for selectively controlling the supply of hydraulic fluid to said piston and cylinder assemblies.

8. Apparatus as recited in claim 7 wherein said control mechanism comprises: a PLC; a plurality of limit and pressure sensors providing input to said PLC; a plurality of solenoids controlled by said PLC for controlling the flow of hydraulic fluid to said hydraulic piston and cylinder assemblies; and an hydraulic pump.

9. Apparatus as recited in claim 6 wherein said control mechanism provides independent control of each of said first through fourth, stripper and clamping linear actuators.

10. Apparatus as recited in claim 1 wherein said workpiece engaging members are separate and distinct elements extending outwardly from said traction arms, each comprising a pin defining an axis and connected to one of said traction arms, and a roller surrounding said pin.

11. Apparatus as recited in claim 10 wherein said first and second traction arms each have first and second ends, said third and fourth axes adjacent to said first ends of said first and second traction arms, respectively, and said pins and rollers adjacent to said second ends of traction arms.

12. Apparatus as recited in claim 6 wherein said control mechanism comprises means for, after a workpiece is brought into operative contact with a die supported by said die support, actuating said clamping linear actuator to clamp the workpiece to prevent wrinkling; then controlling said third and fourth linear actuators to swing said traction arms to move said workpiece engaging members into operative association with the workpiece, and apply pressure thereto; then controlling said first and second linear actuators to retract said control arms while said traction arms continue to apply pressure to the workpiece so that the workpiece conforms to the die mounted by said die support; then de-actuating said clamping linear actuator to unclamp the workpiece, and controlling said third and fourth linear actuators to swing said traction arms away from the workpiece; and then actuating said stripper linear actuator to push the bent workpiece away from the die supported by said die support.

13. Traction bending apparatus for bending workpieces, comprising:

a stationary die support for mounting a die adjacent a first end thereof and having a second end remote from said first end, and an intermediate section between said first and second ends;

at least a first control arm pivotally mounted at a first pivot axis to said die support at a first portion thereof, adjacent said die support second end;

at least a first linear actuator pivotally connected to said first control arm at a second pivot axis and pivotally connected to said die support adjacent said die support second end at a third pivot axis, said first linear actuator providing powered pivoting of said control arm about said first pivot axis;

at least a first traction arm pivotally mounted at a fourth pivot axis to said first control arm at a second portion of said first control arm, remote from said first portion of said first control arm, said fourth pivot axis adjacent but spaced from said second pivot axis;

a workpiece engaging member associated with said first traction arm remote from said fourth pivot axis; and at least a second linear actuator pivotally connected to said first traction arm at a fifth pivot axis adjacent but spaced from said fourth pivot axis, and pivotally connected to said intermediate section of said die support at a sixth pivot axis, said second linear actuator providing powered pivoting of said first traction arm about said fourth pivot axis.

14. Apparatus as recited in claim 13 further comprising a stripper linear actuator mounted to said intermediate section of said die support for effecting movement of a workpiece bent at a die mounted by said die support first end away from said die support.

15. Apparatus as recited in claim 13 further comprising a clamping linear actuator for clamping a workpiece at a die mounted at said die support first end to provide workpiece thickness and wrinkling control.

16. Apparatus as recited in claim 14 further comprising a clamping linear actuator for clamping a workpiece at a die mounted at said die support first end to provide workpiece thickness and wrinkling control.

17. Apparatus as recited in claim 16 wherein said linear actuators comprise hydraulic piston and cylinder assemblies; and further comprising a control mechanism for controlling said linear actuators, said control mechanism comprising means for selectively controlling the supply of hydraulic fluid to said piston and cylinder assemblies.

18. Apparatus as recited in claim 17 wherein said control mechanism comprises: a PLC; a plurality of limit and pressure sensors providing input to said PLC; a plurality of solenoids controlled by said PLC for completely independently controlling the flow of hydraulic fluid to each of said hydraulic piston and cylinder assemblies; and an hydraulic pump.

19. Apparatus as recited in claim 14 wherein said workpiece engaging member comprises a separate and distinct element extending outwardly from said traction arm, and including a pin defining an axis and connected to said traction arm, and a roller surrounding said pin.

20. A method of effecting bending of a workpiece using a stationary die, clamping flanges at the stationary die, and powered workpiece engaging elements, comprising the steps of substantially sequentially:

(a) bringing a workpiece into contact with the stationary die;

(b) effecting direct linear movement of the clamping flanges to provide constant pressure clamping of the workpiece at the die to control thickness and wrinkling of the workpiece;

(c) swinging the workpiece engaging elements into operative abutting contact with the workpiece at the points on the workpiece where bending will occur, and applying pressure to the workpiece with the workpiece engaging elements;

(d) while continuing to maintain pressure on the workpiece with the workpiece engaging elements, moving at least one of the workpiece engaging elements with respect to the stationary die to effect smooth bending of the workpiece while continuing operative abutting contact with the workpiece; and (e) after desired bending of the workpiece, swinging the workpiece engaging elements out of abutting contact with the workpiece, and releasing clamping of the workpiece.

21. A method as recited in claim 20 comprising the further step, between steps (a) and (c), of bringing one or more follow blocks into engagement with the workpiece at a portion of the workpiece opposite the die; and wherein steps (c) and (d) are practiced with the workpiece engaging elements directly abutting the follow blocks and through the follow blocks engaging the workpiece.

22. A method of effecting bending of a workpiece using a stationary die, clamping flanges at the stationary die, and powered workpiece engaging elements, comprising the steps of substantially sequentially:

(a) bringing a workpiece into contact with the stationary die;

(b) effecting direct linear movement of the clamping flanges to provide constant pressure clamping of the workpiece at the die to control thickness and wrinkling of the workpiece;

(c) swinging the workpiece engaging elements into operative abutting contact with the workpiece, and applying pressure to the workpiece with the workpiece engaging elements;

(d) while continuing to maintain pressure on the workpiece with the workpiece engaging elements, moving at least one of the workpiece enraging elements with respect to the stationary die to effect smooth bending of the workpiece while continuing operative abutting contact with the workpiece;

(e) after desired bending of the workpiece, swinging the workpiece engaging elements out of abutting contact with the workpiece, and releasing clamping of the workpiece; and after step (e), effecting powered linear movement of the workpiece away from the die.

23. A method as recited in claim 20 wherein steps (a)–(e) are practiced so that the workpiece is bent in a generally horizontal plane without top constraints, so that any length workpiece can be bent.

24. A method as recited in claim 20 wherein the workpiece comprises a tube or an aluminum extrusion and wherein steps (a)–(e) are practiced to bend the workpiece more than 90°.

25. A method as recited in claim 20 wherein steps (c) and (d) are practiced by applying a variable pressure with the workpiece engaging elements to effect cold forging of the workpiece for springback control.

26. A method as recited in claim 20 wherein step (c) and (d) are practiced by providing independent variable control of each of the workpiece engaging elements to provide smooth 90° or more bending of non-symmetric workpieces.

27. A method as recited in claim 20 wherein step (d) is practiced by moving both of the workpiece engaging elements with respect to the die to effect smooth symmetric bending of the workpiece, with rolling operative abutment of the workpiece.

28. A method as recited in claim 20 wherein the die has a shape clearly distinct from a circular arc, and wherein steps (a)–(e) are practiced so that the workpiece is bent with at least one bend clearly distinct from a circular arc.

* * * * *